United States Patent [19]

Haase

[11] 4,407,038

[45] Oct. 4, 1983

[54] MAGNETIC SWEEPER

[76] Inventor: Gerald A. Haase, 1005 Country Club Rd., Lake Oswego, Oreg. 97034

[21] Appl. No.: 325,230

[22] Filed: Nov. 27, 1981

[51] Int. Cl.[3] ..... B03C 1/30; H01F 7/02

[52] U.S. Cl. ..... 15/105; 15/3; 209/215

[58] Field of Search ..... 15/3, 105, 339; 209/215; 335/285

[56] References Cited

U.S. PATENT DOCUMENTS

| | | | |
|---|---|---|---|
| 1,745,970 | 2/1930 | Andrew | 209/215 |
| 3,377,641 | 4/1968 | McGregor | 15/105 |
| 3,646,492 | 2/1972 | Westermann | 209/215 |

*Primary Examiner*—Edward L. Roberts
*Attorney, Agent, or Firm*—Oliver D. Olson

[57] ABSTRACT

A hand operated magnetic sweeper comprises a longitudinally elongated, reinforced body member molded in one piece of non-magnetic material with wheels mounted for rotation on the longitudinal ends thereof, the body including a handle socket on its top side arranged to support a handle for angular extension vertically upward and rearward therefrom. The body is configured with longitudinally extending magnet holding pockets arranged along its longitudinal centerline so that magnets contained therein have a pair of adjacent perpendicular surfaces disposed at different distances from the circumference of the wheels, whereby each of said surfaces may be positioned to face downward toward an underlying surface by rotation of the body through 90° relative to the surface. A brush is mounted to the rear edge of the body for sweeping contact with a surface when the sweeper is rolled over the surface.

3 Claims, 5 Drawing Figures

MAGNETIC SWEEPER

BACKGROUND OF THE INVENTION

This invention relates to sweepers, and more particularly to a self-contained magnetic sweeper arranged to capture loose magnetic objects from floors, yards and construction sites as the sweeper is rolled over the surface.

Devices for the removal of metallic objects from a floor have been provided heretofore. Applicant's magnetic attachment for vacuum cleaners, U.S. Pat. No. 4,279,745 is an example of the most pertinent prior art known to applicant.

U.S. Pat. No. 2,677,461 discloses a magnetic pickup device for attachment to a vacuum cleaner which may alternatively be provided with a handle by which the device may be manually dragged across a floor.

Other prior art known to applicant is U.S. Pat. Nos. 2,288,114 and 2,862,224, both disclosing magnetic pickup attachments for floor cleaning and polishing devices.

SUMMARY OF THE INVENTION

In its basic concept, this invention provides a self-contained magnetic sweeper arranged to present a permanent magnet at a predetermined distance above a surface while the sweeper is being hand propelled across the surface on wheels.

It is by virtue of the foregoing basic concept that the principal objective of this invention is achieved; namely, the provision of a device by which the simple and efficient removal of metallic objects from a surface is obtained.

Another object of this invention is the provision of a magnetic sweeper of the class described in which wheels are rotatably mounted to axles disposed on the opposite longitudinal ends of the sweeper body to support sweeper magnets above a surface during operation, the magnets being mounted relative to the axis of rotation of the wheels so that by simple rotation of the body about the axis of the wheels the distance between the magnets and the underlying surface may be adjusted.

A further object of this invention is the provision of a magnetic sweeper of the class described which may include a sweeping brush mounted on the body for sweeping a surface or smoothing a carpet or penetrating a carpet or grass to dislodge entangled objects for retrieval by the magnet as the sweeper is rolled across the surface.

A still further object of this invention is the provision of a magnetic roller sweeper of the class described which does not require attachment to existing vacuum cleaners or other devices, and is of simplified construction for economical manufacture and operation.

The foregoing and other objects and advantages of this invention will appear from the following detailed description, taken in connection with the accompanying drawings of a preferred embodiment.

DESCRIPTION OF THE PREFERRED EMBODIMENT

Figures 1, 2, 3, 4, 5:
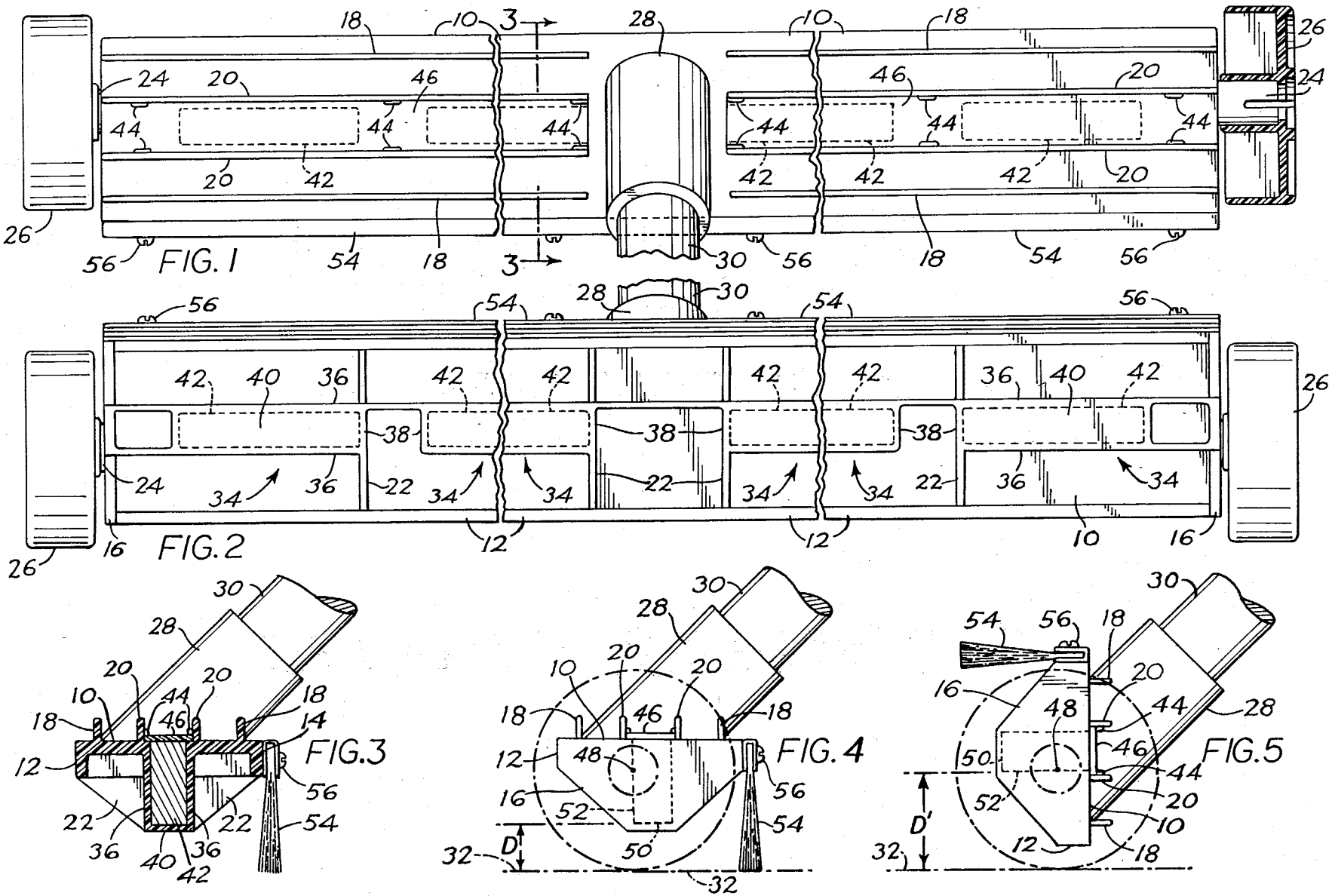
FIG. 1 is a fragmentary foreshortened plan view of the top of a magnetic sweeper embodying the features of this invention.
FIG. 2 is a fragmentary foreshortened plan view of the underside of the sweeper of FIG. 1.
FIG. 3 is a fragmentary horizontal section of the sweeper of FIG. 1, taken along the line 3—3 in FIG. 1.
FIG. 4 is a fragmentary end view of the sweeper as seen from the left in FIG. 1.
FIG. 5 is a fragmentary end view of the sweeper changed from the position of FIG. 4 by rotating the sweeper body and handle 180° about the longitudinal axis of the handle.

FIGS. 1 and 2 illustrate views of the top and bottom, respectively, of the magnetic sweeper of this invention. As illustrated in the drawings, the sweeper comprises a main body member formed of an elongated plate 10 reinforced by a downwardly xtending front wall 12, rear wall 14 and end walls 16. Further reinforcement is provided by means of upwardly extending outer longitudinal ribs 18 and inner longitudinal ribs 20, and intermediate cross ribs 22. The body member is formed of non-magnetic material and preferably is molded of plastic in one piece to minimize manufacturing costs.

The sweeper is illustrated as including axles 24 mounted to and extending outwardly from the longitudinal end walls 16 of the base plate. The axles are mounted on the ends forward of the longitudinal centerline of the plate 10, and each is configured to receive for rotation a wheel 26 which may be mounted detachably on the axle by any conventional means, such as the resilient split axles illustrated.

The magnetic sweeper includes a handle socket 28 centrally located on the top of the plate 10. As illustrated, the socket projects angularly upwardly and rearwardly from the base plate 10. A handle 30 is secured, as by a press fit, to the socket 28 for extension therefrom, and the handle is of sufficient length to be comfortably held by hand while the wheels supporting the base plate 10 are disposed in rolling contact with an underlying floor or other surface 32.

As shown in FIGS. 2 and 3, a plurality of recesses, embodied herein as longitudinally spaced pockets 34, are formed integrally with the plate 10 on opposite sides of the handle socket. As illustrated, each pocket is positioned along the longitudinal centerline of the plate. Each of the body pockets includes spaced side walls 36, end walls 38 and a bottom wall 40 configured to form a receptacle for holding a permanent magnet 42. The top of each pocket is open for the removable reception of a magnet.

Means for releasably securing the magnets in their respective pockets is best illustrated in FIGS. 1 and 3. Intermediate longitudinal ribs 20 extend along opposite sides of the magnet pockets and incorporate inwardly projecting tabs 44 spaced above the upper surface of the body plate 10. Pocket cover strips 46 are arranged to be slid into place between the tabs and the top of the plate, from the outer ends of the plate 10 before the wheels are installed. The strips thereby releasably secure the magnets 42 inside the confines of the pockets.

It is to be noted, particularly from FIGS. 4 and 5, that the magnets 42 are positioned relative to the axis 48 of rotation of wheels 26 of a selected diameter in such manner that when the sweeper is in the position of FIG. 4 the bottom face 50 of the magnet is spaced from the floor 32 a predetermined distance D, for example 1.25 cm., and when the sweeper is in the position of FIG. 5 the bottom face 52 of the magnet is spaced from the floor a predetermined different distance D', for example 2.5 cm.

To achieve the operative position of FIG. 5 from the operative position of FIG. 4, the body and handle assembly may be rotated 180° about the longitudinal axis of the handle 30. Alternatively, the body and handle assembly may be rotated 90° counterclockwise about the common axis 48 of the wheels in FIG. 4, in which case the handle will extend upwardly toward the left instead of toward the right, as shown in FIG. 5.

The distance D and D' may be varied as desired by appropriate selection of the diameter of the wheels 26 and by positioning the magnet surfaces 50 and 52 at desired distances from the axis 48 of rotation and hence the circumference of the wheels. The surfaces 50 and 52 also may be disposed at angles other than perpendicular to each other.

The sweeper of this invention may also include, as illustrated, an elongated sweeper brush 54 mounted, as by screws 56, to the rear wall 14 of the plate 10 for wiping a floor or smoothing a carpet as the sweeper device is being rolled. In this manner the sweeper, while capturing metallic objects, may be utilized to clean up dust and dirt or for removing undesirable tracks and footprints left on carpets. The brush also may be used to dislodge paper clips and other objects entangled in deep carpeting or in lawn grass and thus expose them for retrieval by the magnets.

The operation of the magnetic sweeper is as follows: Magnets 42 are placed in the respective magnet pockets 34 and the cover strips 46 are slid into place between the tabs 44 and body plate 10, from the outer ends of the latter, thereby securing the magnets in the pockets. The wheels 26 are then rotatably attached to the axles 24 and the handle 30 is secured to the handle socket 28. The sweeper is placed on the floor, or other surface to be swept magnetically, resting on the wheels 26. As the sweeper is hand propelled across the surface, the magnet surfaces capture any loose magnetic matal objects. When arranged in the position of FIG. 4, the brush 54 drags across the surface moving dust or dirt, dislodging metallic objects captured in the nap of a carpet, and smoothing the surface of the latter.

If it is desired that a magnet surface be maintained a greater distance above a surface to be swept, as in the case of an uneven surface, or of deep pile carpeting or lawn grass, or the sweeping action of the brush 54 is not desired, the sweeper is inverted by rotating the sweeper handle 180° about its axis, or by rotating the body 90° counterclockwise about the wheel axis 48, to achieve the position of FIG. 5. In this position the magnet surface 52 is facing downward, spaced a greater distance from the surface to be swept, than was magnet surface 50 in the position of FIG. 4.

The sweeper may be adjusted to either of the positions of FIGS. 4 and 5, as desired, for sweeping a variety of surfaces such as garage floors, driveways, low pile carpet, high pile carpet, outdoor yard areas, lawns, construction sites and others.

It will be apparent to those skilled in the art that various changes, in addition to those previously mentioned, may be made in the size, shape, type, number and arrangement of the parts described hereinbefore without departing from the spirit of this invention and the scope of the appended claims.

Having thus described my invention and the manner in which it may be used, I claim:

1. A magnetic sweeper, comprising:

(a) a transversely elongated, unitary non-magnetic body having an outwardly projecting handle member centrally mounted on its top surface, (b) the body configured with at least one magnet retaining pocket on each side of the handle, each pcoket having an open side for removable reception of a permanent magnet, (c) each magnet configured with one side surface having a given area and a second side surface disposed 90 degrees relative to the first side and having a larger surface area, and (d) wheels on the opposite ends of the body mounted for rotation on a transverse axis, (e) the pockets on said body arranged to support said one side surface of each magnet a predetermined distance inward of the outer circumference of the wheels and the second, larger side surface a predetermined greater distance inward of the outer circumference of the wheels, whereby in one position of the body the said one side surfaces of the magnets are positioned in a predetermined distance above and facing an underlying surface to be swept, and in a second position of the body, rotated 90 degrees from said first position, the said larger second side surface of the magnets are positioned a predetermined greater distance above and facing an underlying surface to be swept.

2. The magnetic sweeper of claim 1 including cover strip means arranged to removably overlie said open side of the pocket on each side of the handle for releasable closing of the pockets against removal of the magnets, and retainer means on the body arranged to retain each cover strip in said releasably closed, magnet retaining position.

3. The magnetic sweeper of claim 1 including a sweeper brush mounted on one longitudinal side of said body, and the sweeper brush arranged to contact a surface to be swept when the sweeper is disposed with said one magnet side surface in operative position.

* * * * *